US007154388B2

(12) United States Patent
Mazzone

(10) Patent No.: US 7,154,388 B2
(45) Date of Patent: Dec. 26, 2006

(54) VEHICLE COMPARTMENT SMOKE AND FIRE INDICATION SYSTEM AND METHOD FOR USE

(75) Inventor: Richard J Mazzone, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 16 days.

(21) Appl. No.: 10/712,330

(22) Filed: Nov. 13, 2003

(65) Prior Publication Data

US 2005/0146427 A1 Jul. 7, 2005

(51) Int. Cl.
*G08B 23/00* (2006.01)

(52) U.S. Cl. ..... 340/520; 340/517; 340/523; 340/524; 340/525; 340/577; 340/628

(58) Field of Classification Search ..... None
See application file for complete search history.

(56) References Cited

U.S. PATENT DOCUMENTS

| | | | | |
|---|---|---|---|---|
| 4,001,819 | A * | 1/1977 | Wise | 340/521 |
| 4,198,625 | A * | 4/1980 | Mande et al. | 340/517 |
| 4,581,604 | A * | 4/1986 | Kimura et al. | 340/521 |
| 4,870,394 | A * | 9/1989 | Corl et al. | 340/630 |
| 4,933,667 | A * | 6/1990 | Shaw et al. | 340/525 |
| 5,202,673 | A * | 4/1993 | Conrad | 340/524 |
| 5,899,414 | A * | 5/1999 | Duffoo | 244/139 |
| 6,351,212 | B1 * | 2/2002 | Lynch | 340/506 |
| 6,529,137 | B1 | 3/2003 | Roe | |
| 6,771,185 | B1 * | 8/2004 | Yoo et al. | 340/932.2 |
| 6,798,342 | B1 * | 9/2004 | Addy | 340/539.1 |
| 6,917,288 | B1 * | 7/2005 | Kimmel et al. | 340/511 |
| 6,972,676 | B1 * | 12/2005 | Kimmel et al. | 340/506 |
| 2001/0011946 | A1 | 8/2001 | Horon | |

FOREIGN PATENT DOCUMENTS

| | | |
|---|---|---|
| GB | 2262444 | 6/1993 |
| WO | WO 01/03094 | 1/2001 |

OTHER PUBLICATIONS

"Latest Fire Detection System Offers Active Reaction, Flexibility", IPN International Product News, Aviation Week & Space Technology, Sep. 22, 1997, pp. 90-91.
"Our New SP-1 PyroSense Controller", www.pyrogen.com Website Article, Aug. 12, 2003, 5 pages.
"Pyrosense SP-1 Control Device", Technical Data Sheet V. 1.0, Pyrogen (UK) Ltd., Feb. 25, 2002, 4 pages.
"Automatic Fire Detection and Monitoring System (AFDAMS)", www.pygrogen.com Website Article, Aug. 12, 2003, 3 pgs.
Fire Safety Product Applications, Siemens, www.siemens.com Website Article, Aug. 11, 2003 2 pgs.
"737 / 757 Panels, Flight Deck P5 Modules", cas.ca.boeing.com Website Article, Aug. 8, 2003, 3 pages.
"Flight and Cabin Crew Response to in-Flight Smoke", Boeing Safety Pamphlet, Undated, 5 pages.

(Continued)

*Primary Examiner*—Benjamin C. Lee
*Assistant Examiner*—Son Tang
(74) *Attorney, Agent, or Firm*—Harness Dickey & Pierce P.L.C.

(57) ABSTRACT

A mobile platform fire detection system includes a plurality of smoke detectors locatable in a compartment of a mobile platform. Heat sensors are also positioned in the compartment. At least one indication panel is located outside of the compartment and adjacent to an entranceway into the compartment. The indication panel operates to identify an alarm condition of each of the smoke detectors and the heat sensors.

26 Claims, 7 Drawing Sheets

OTHER PUBLICATIONS

"High-Tech Fire Detection and Suppression System", News Release, www.portofbellingha, Michele Higgins, Sep. 16, 1997, 2 pages.

"Industry's Role in Aviation Safety", Jetliner Safety Working Together, www.boeing.com Website Article, Aug. 8, 2003, 10 pages.

"ALPA Letter to FAA Regarding Fire Protection", Aviation Today Special Report, May 20, 1999, 11 pages.

"Cabin & Fire Safety: A Perspective from the Cockpit", Thomas Phillips and Pierre Huggins, Accident Survival Committee Air Line Pilots Association, Nov. 17, 1998, 10 pages.

"NTSB Review of Crew Actions During In-Flight Fires", NTSB Review, Jan. 2002, 7 pages.

"Future Trends in Aircraft Fire Safety R&D", The Future of Fire Safety R&D, Constantine P. Sarkos, www.gwu.edu Website, Aug. 12, 2003, 10 pages.

"Status on FIREDETEX", Cargo Center ECC, Konstantin Kallergis, IASFPWG Meeting, London, UK, Jun. 13-14, 2002, 7 pages.

"Cargo Compartment Fire Verification System, Fire Protection System", Klaus Schmoetzer, International Aircraft Systems Fire Protection Working Group Meeting in London, Jun. 13-14, 2002, (May 14, 2002), 11 pages.

"Multi Criteria Fire/Smoke Detector for Cargo Holds", Airbus, Klaus Schmoetzer, International Aircraft Systems Fire Protection Working Group Meeting in Phoenix on Mar. 26-27, 2003, 16 pages.

"Aircraft Command in Emergency Situations (ACES) Phase I: Concept Development", Thomas L. Reynolds, Complete Record Information, WorldPAC Copyright, 1995,96 Electronic Online Systems (EOS) International, 133 pages.

* cited by examiner

○ = Smoke Det ctor
◇ = Heat Sensor
⬡ = Fire Extinguisher

VEHICLE COMPARTMENT SMOKE AND FIRE INDICATION SYSTEM AND METHOD FOR USE

FIELD OF THE INVENTION

The present invention relates in general to fire alarm systems and more specifically to a mobile platform fire/smoke indication system and a method for identifying the presence of fire and/or smoke.

BACKGROUND OF THE INVENTION

Mobile vehicles including aircraft, ships, trains, busses, etc. and other public transportation vehicles are commonly configured into a variety of different compartments, each of which can be the source of smoke and/or a fire. Compartments can be configured for passenger seating, crew use, lavatories, food preparation, baggage storage, cargo handling/storage, conference rooms, sleeping quarters, etc. Compartments which are normally unmanned or that can be isolated by separate doors commonly use smoke detection equipment, including ionizing smoke detectors, to signal the presence of smoke, and therefore the possible presence of fire, to personnel outside of these compartments. The smoke detectors "alarm" at a predetermined threshold of smoke, and any one or all of the smoke detectors can also be coordinated into a smoke/fire detection/indication system. This type of system is commonly identified as a "passive" system. Fires in these areas are commonly extinguished by hand-held devices operated by personnel who enter the compartment. More complex unmanned compartment fire systems tie smoke detectors into a fire suppression control system to apply suppression material, including water or more commonly halon, to deluge the compartment when smoke detectors alarm. These systems are commonly identified as "active" fire detection/suppression systems.

With the above described systems, smoke detectors, alone, do not identify the temperature in the alarming section, and therefore are unable to alert personnel if an actual fire or if a smoldering condition exists. Many smoke detector systems are wired to alarm all areas when smoke is detected in only one area. This can sometimes complicate determining which area personnel should approach first. Known systems also do not identify which detector was the first to alarm, thus signifying the most appropriate area to check first. Active systems using halon as the fire suppressant are generally considered unacceptable for use in possible personnel occupied areas, because flooding a compartment with halon can yield toxic byproducts of combustion. Therefore, personnel occupied areas, in general, normally require crew or trained personnel to combat fires using fire extinguishers. The presence of heavy smoke in a compartment entered by personnel entrusted to fight the fire can prevent rapid detection of the presence of, or actual location of, a fire.

Current aircraft commonly provide a single panel located near a crew station, such as a crew seating area, which includes one or more lights indicating that one or more smoke detectors are alarming, including smoke detectors in individual lavatories. No indication is provided, however, of which indicator was the first to alarm. Also, with the single panel now used, personnel about to enter a compartment remote from the panel have no indication of where a possible fire might be within that compartment, or if conditions within the compartment would be unsafe for personnel entry.

SUMMARY OF THE INVENTION

According to a preferred embodiment of the present invention, a plurality of smoke detectors are located in a compartment of a mobile platform. A plurality of heat sensors are each positioned adjacent to at least one of the smoke detectors. At least one indication panel is located outside of the compartment and adjacent to an entranceway into the compartment. The panel is operable to identify an alarm condition of each of the smoke detectors and the heat sensors.

According to another aspect of the present invention, a plurality of smoke detector signaling indicatiors are each remotely connectable to one of the smoke detectors and indicate an alarm condition of each smoke detector, and a pluraliy of heat sensors signaling indicators are each remotely connectable to one of the heat sensors and indicate an alarm condition of each heat sensor. A first one of the smoke detectors signaling indicators and a first one of the sensor signaling indicators to indicate the alarm condition define a distinct indication signal differentiable from any subsequent one of the signaling smoke detector or heat sensor indicators to indicate the alarm condition.

In still another aspect of the present invention, a mobile platform fire detection/indication system comprises a panel having a plurality of indicators, each of the indicators remotely connectable to one of a smoke detector and a heat sensor. A compartment mimic is disposed on the panel defining a general configuration of a mobile platform compartment. A predetermined position for each of the indicators on the mimic define an approximate location of each of the smoke detectors and the heat sensors within the compartment.

In yet another aspect of the present invention, a method for identifying the presence of smoke and fire in a mobile platform, the mobile platform having a plurality of smoke detectors and a plurality of heat sensors, each connectable through a control loop to a predetermined indicator on a remote panel, comprises positioning the panel adjacent an entrance into a mobile platform compartment. An alarm signal is routed from each of the smoke detectors through the control loop to operably distinguish a first alarming smoke detector. An alarm signal is passed from each of the heat sensors through the control loop to operably distinguish a first alarming heat sensor. A first one of the predetermined indicators connectable to the first alarming smoke detector is energized with a first smoke detector alarm pattern. A second one of the predetermined indicators connectable to the first alarming heat sensor is energized with a first heat sensor alarm pattern.

The features, functions and advantages can be achieved independently in various embodiments of the present invention, or may be combined in yet other embodiments.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

The present invention is applicable to multiple types of mobile platforms including aircraft, ships, trains, busses, trucks, motor homes, etc. The exemplary application of the present invention is described in relation to an aircraft, however, the principles of the present invention are not limited to the exemplary aircraft described herein and may be used in the other above-mentioned mobile platforms or even in fixed, non-moving structures.

Figure 1:
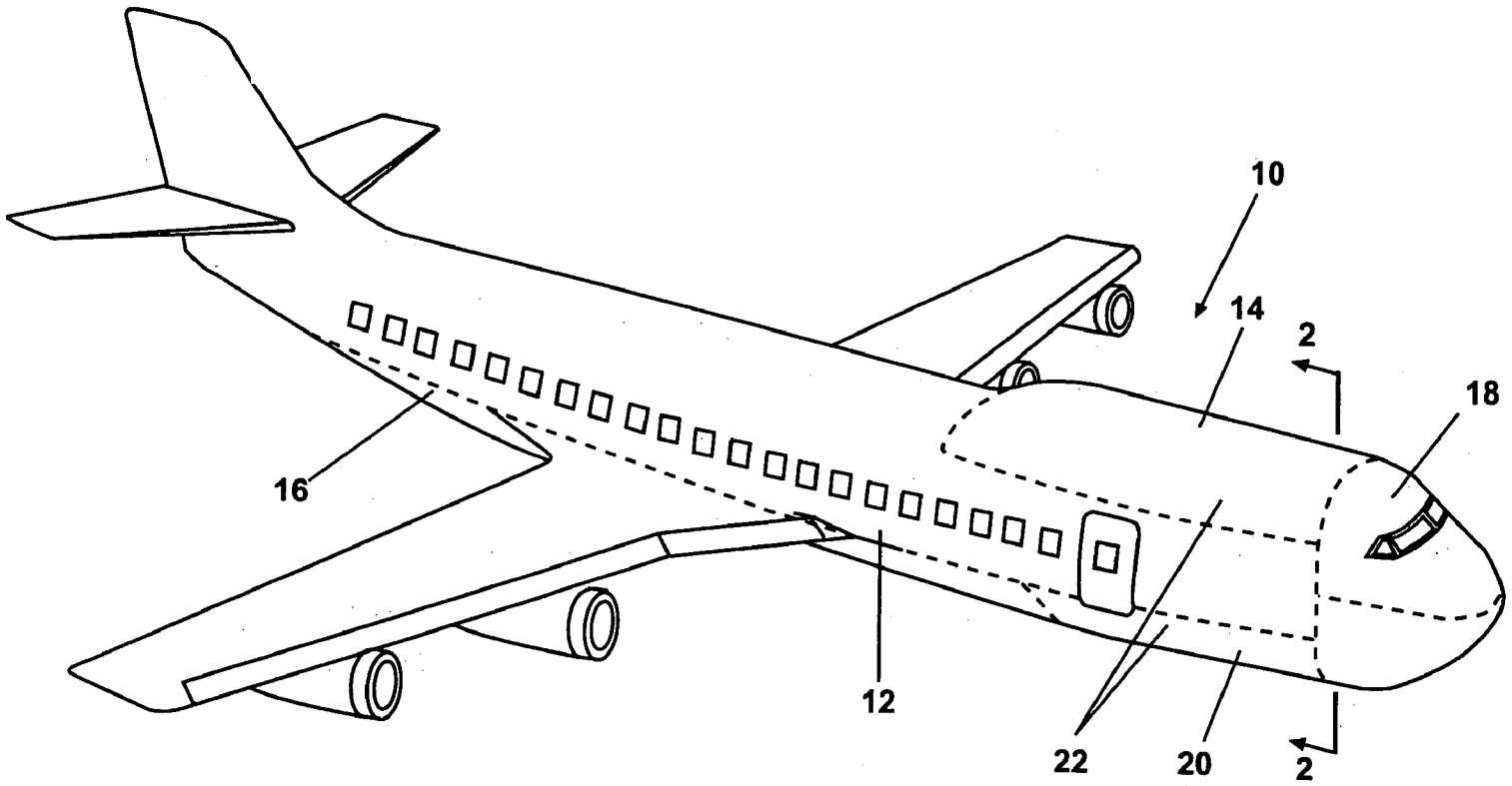
FIG. 1 is a perspective view of an aircraft having a vehicle compartment smoke and fire indication system of the present invention.

Referring to FIG. 1, an exemplary aircraft 10 is shown having a passenger area 12, an upper occupied area 14, a cargo area 16, a cockpit area 18, and a lower occupied area 20. According to a preferred embodiment of the present invention, a smoke and fire indication system 22 is used in upper occupied area 14 and lower occupied area 20, respectively. Passenger area 12 generally does not have smoke detectors or fire indication systems due to the normally occupied condition of passenger area 12 where passengers would normally see and alert crew to the presence of smoke and/or fire. Cargo areas, such as cargo area 16 are generally not accessible to personnel during flight, therefore localized indication of conditions within cargo area 16 adjacent to an access door would normally not be available to personnel during an aircraft flight. Similarly, cockpit area 18 is normally manned and therefore personnel are normally available to identify the presence of smoke and/or fire. Both upper occupied area 14 and lower occupied area 20 are locations where personnel or crew have access to during flight, but are normally unoccupied during certain periods of time such as during take-off and landing procedures. Smoke and/or fire events within upper occupied area 14 or lower occupied area 20 during a take-off or landing procedure would not normally be identified by personnel.

Figure 2:
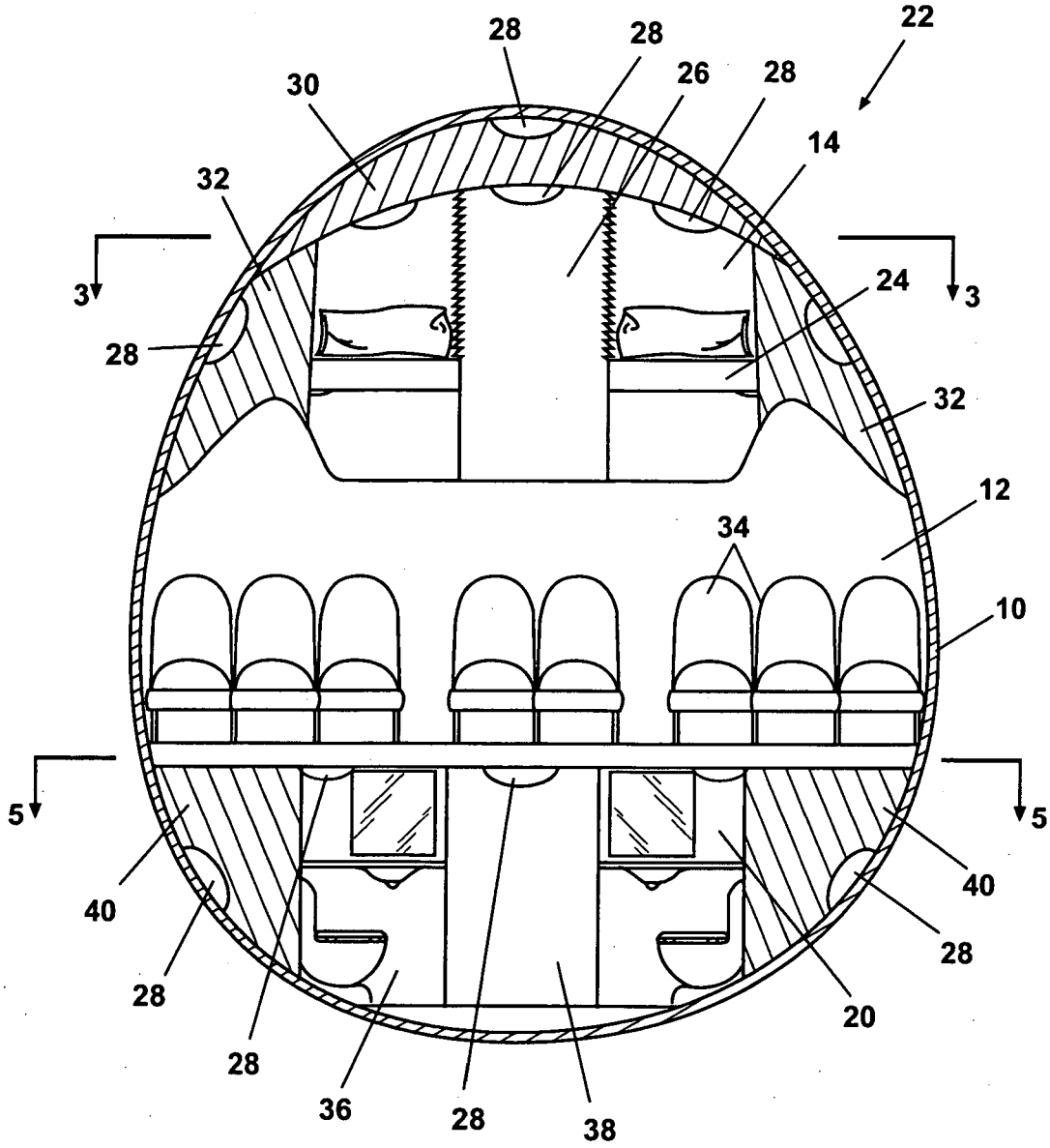
FIG. 2 is a cross-sectional elevational view taken at Section 2—2 of FIG. 1.

Referring next to FIG. 2, upper occupied area 14 can include one or more berths 24 separated by one or more passageways 26. A plurality of smoke/heat detectors 28 are shown mounted in generally upper elevated areas of both berth 24 and passageway 26. Smoke/heat detectors 28 are preferably arranged at upper elevations due to the buoyancy differences between ambient air and heated air or smoke. Heated air or smoke generally tend to rise quickly to upper elevations and would therefore be detected quicker by elevated positions of smoke/heat detectors 28. Although unmanned during normal operations, aircraft 10 also includes a crown area 30 which can have at least one smoke/heat detector 28, and a pair of outboard located crown areas 32 which can also have at least one smoke/heat detector 28 positioned therein. As noted previously, passenger area 12, in a preferred embodiment, does not include smoke/heat detectors 28 due to the normal presence of personnel in this space and the capability of quickly identifying smoke and/or fire in passenger area 12.

Lower occupied area 20 is shown having an opposed pair of lavatories 36 separated by a passageway 38. Each of the lavatories 36 and passageway 38 include a smoke/heat detector 28. Similar to upper occupied area 14, lower occupied area 20 also has opposed lower cheek areas 40 which are unoccupied but can benefit from the present invention. Each lower cheek area 40 is provided with a smoke/heat detector 28.

Figure 3:
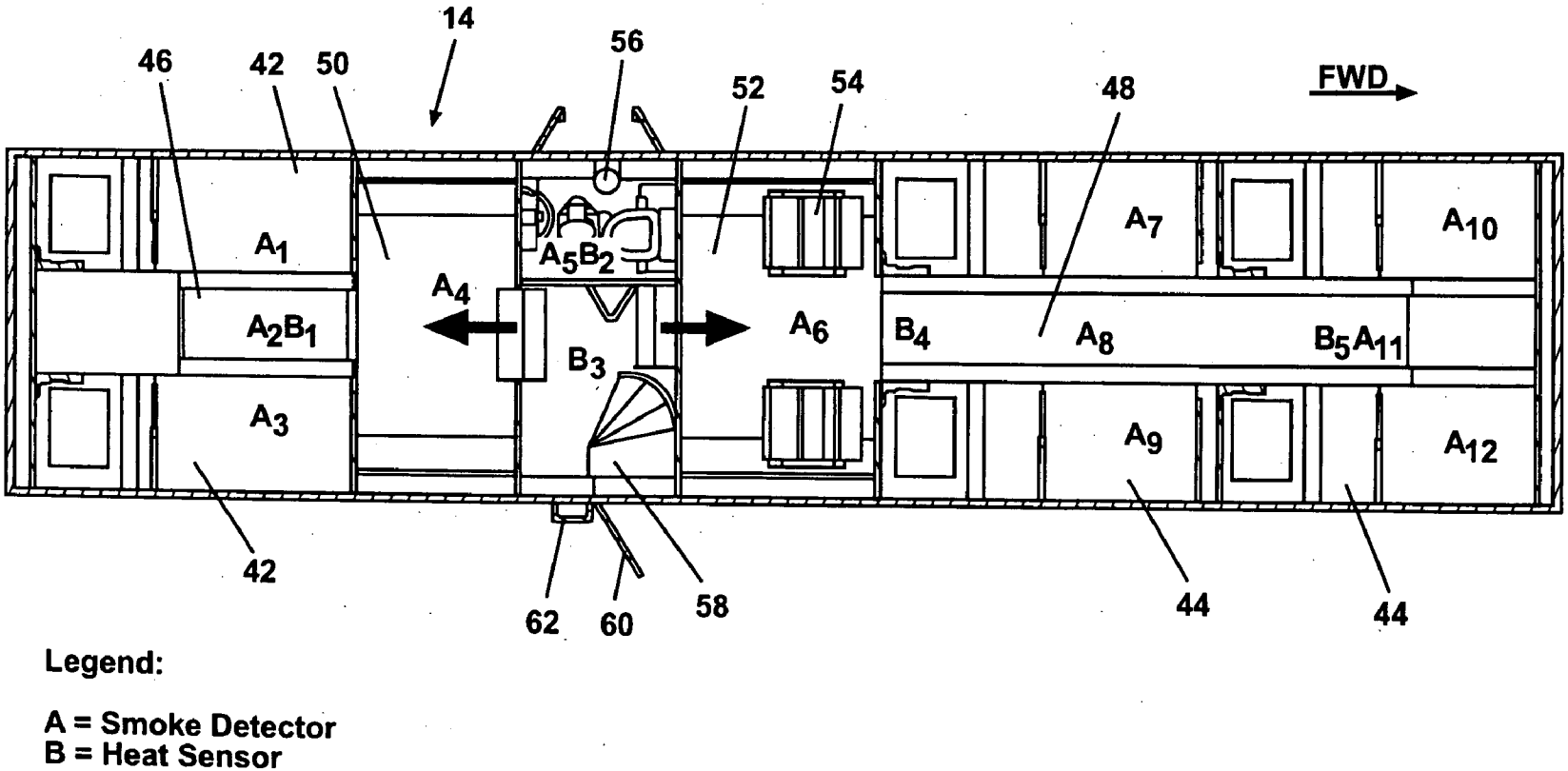
FIG. 3 is a plan view of an upper compartment of an aircraft taken at Section 3—3 of FIG. 2.

Referring next to FIG. 3, the plan view of upper occupied area 14 identifies a plurality of locations where smoke and/or fire, if present, may not be immediately detectable to crew or personnel due to doors or curtains being closed or during certain operating procedures. Upper occupied area 14 includes a plurality of aft berths 42 and a plurality of forward berths 44. Each berth 42 and 44 is normally isolated by a curtain or door. Access to individual aft berths 42 is via an aft passageway 46. Access to individual forward berths 44 is via a forward passageway 48. A lounge area 50 includes a seating area 52 having a plurality of seats 54 and a lavatory 56. In the arrangement shown, access to upper occupied area 14 is via a stairway 58 which is isolated by a door 60. According to a preferred embodiment of the present invention, aft berths 42 are provided with individual smoke detectors $A_1$ and $A_3$. A smoke detector $A_2$ is provided in aft passageway 46. A smoke detector $A_4$ is located in lounge area 50. A smoke detector $A_5$ is located in lavatory 56. A smoke detector $A_6$ is located in seating area 52. Individual smoke detectors $A_7$, $A_9$, $A_{10}$, and $A_{12}$ are located in individual ones of forward berths 44. Due to the relative length of forward passageway 48, two smoke detectors, identified as $A_8$ and $A_{11}$, are positioned at approximate opposite ends of forward passageway 48. Each smoke detector is individually mounted and is hardwired to a display panel 62 positioned outside of upper occupied area 14.

In addition to the smoke detectors labeled $A_1$ through $A_{12}$, upper occupied area 14 further includes a plurality of heat sensors identified as $B_1$ through $B_5$. Each heat sensor is positioned in an area which is distinguishable from other areas of upper occupied area 14. For example, heat sensor $B_1$ is located in the zone including aft berths 42 and aft passageway 46. Heat sensor $B_1$ therefore identifies when a temperature increase threshold limit is reached for the area adjacent to heat sensor $B_1$. Because lavatory 56 is normally closed and isolated by a separate door, in addition to smoke detector $A_5$, lavatory 56 also includes an individual heat sensor $B_2$. Heat sensor $B_3$ is preferably positioned at an upper elevation adjacent to the top of stairway 58. An alarming heat sensor $B_3$ indicates that temperature in the area of stairway 58 could affect access to upper occupied area 14 by personnel seeking to enter the area. A heat sensor $B_4$ is positioned towards an aft end of forward passageway 48. In this position, heat sensor $B_4$ encompasses seating area 52 and the aft end berths of this area. A heat sensor $B_5$ is similarly positioned at a forward end of forward passageway 48. Heat sensor $B_5$ covers the forward area of upper occupied area 14 including the forward-most of forward berths 44 and the forward end of forward passageway 48. Similar to smoke detectors $A_1$ through $A_{12}$, each heat sensor $B_1$ through $B_5$ is preferably hard wired to display panel 62. The present invention is not limited to smoke detectors provided as separate units from heat sensors. A combination smoke detector/heat sensor unit can also be used where suitable.

Aircraft are commonly designed to a maximum temperature point which can occur due to maximum ambient conditions of sunlight during a parked or stationary condition of the aircraft. This temperature is approximately 160° F. Each of the heat sensors $B_1$ through $B_5$ are therefore preferably set to alarm at a temperature higher than the maximum ambient temperature of the aircraft. In a preferred embodiment, heat sensors $B_1$ through $B_5$ are each preset to alarm at a temperature of approximately 175° F. This provides some margin between the maximum normal conditions of the aircraft and the alarm setpoint to limit heat sensor false alarms. The 175° F. temperature also provides a practical limit for personnel entering a compartment to fight a fire. Temperatures in excess of 175° F. could prevent personnel access to these spaces.

Display panel 62 is located outside of upper occupied area 14 such that personnel seeking to enter door 60 have visible indication of an alarming smoke detector and/or an alarming heat sensor. Display panel 62 is preferably positioned adjacent to door 60 as well as to a position adjacent heat sensor $B_3$ such that thermal conditions on the upper occupied area 14 side of door 60 can be ascertained before door 60 is opened. If heat sensor $B_3$ is not alarming, a lack of alarm indication on display panel 62 provides personnel with an indication that fire or high temperatures may not be present immediately on the opposite side of door 60.

Figure 4:
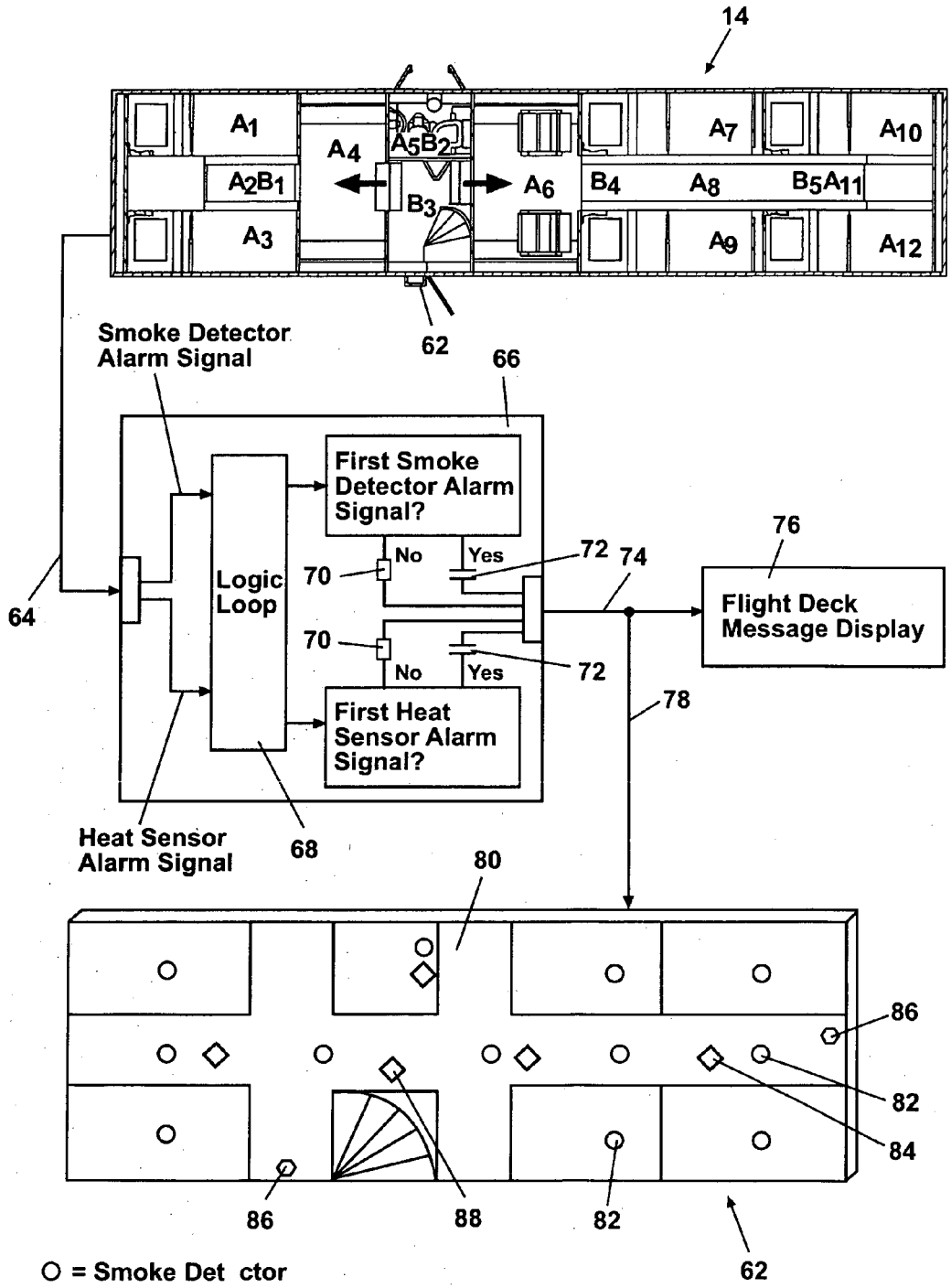
FIG. 4 is a diagrammatic view of an exemplary system configuration including a control unit and a display panel of the present invention.

As best seen in FIG. 4, a signal transfer line 64 represents each of the wires or data feed lines coming from each of the smoke detectors and heat sensors in upper occupied area 14. Signal transfer line 64 is preferably a hard wired bank of signal wires but can also be a data transfer path, if individual signals from the smoke detectors and/or the heat sensors are transmittable, for example as radio-frequency (RF) signals between the individual detectors or sensors and a control unit 66. Control unit 66 can be either adjacently or remotely located from upper occupied area 14. Control unit 66 includes a logic loop 68, at least one relay switch 70 and at least one capacitor 72. A signal indicating an alarm condition from any of the smoke detectors or heat sensors is first transferred to logic loop 68 via signal transfer line 64. Logic loop 68 identifies a first alarming one of the smoke detectors and a first alarming one of the heat sensors. The alarm signal from logic loop 68 is then passed through a relay switch 70 or biases one of the capacitors 72.

The first alarming smoke detector signal and the first alarming heat sensor signal each bias one of the capacitors 72 and are transferred as an intermittent signal to the appropriate indicator (which blinks in response to the intermittent signal during the alarm event) on control display panel 62. Second or subsequent smoke detector or heat sensor alarm signals latch-on one of the relay switches 72 and are transferred as a continuous signal to the appropriate indicator on control display panel 62 (which are continuously energized during the alarm event). From control unit 66, each of the signal lines from the smoke detectors and the heat sensors are forwarded via a combined output line 74 (similar to signal transfer line 64) to either a flight deck message display 76 or via a display panel combined line 78 to display panel 62. Messages received at flight deck message display 76 generally alert the flight crew only to an alarming condition of a smoke detector or a heat sensor in a particular area of the aircraft.

Display panel 62 includes a mimic overlay 80. Mimic overlay 80 is designed to show the general configuration within upper occupied area 14. In the embodiment shown in FIG. 4, each of the smoke detectors $A_1$ through $A_{12}$ are indicated as a circular light emitting diode (LED). According to a preferred embodiment of the present invention, the first alarming smoke detector is signified at display panel 62 by a blinking smoke detector LED 82. Any subsequent smoke detector to alarm will be indicated by a constant "ON" LED indication. Indicators for the heat sensors are shown on mimic overlay 80 as exemplary diamond shaped heat sensor LEDs 84. Similar to the smoke detector LEDs, the first alarming heat sensor is indicated by a flashing heat sensor LED 84. Any subsequent heat sensor to alarm is indicated as a steady "ON" LED indication. Also, in the embodiment shown, to further distinguish smoke detector indicators from heat sensor indicators, each smoke detector LED 82 is provided with a specified color, for example orange. Each heat sensor LED 84 is provided with a distinct color, for example, red. This color differentiation further aids when personnel view display panel 62 to indicate whether a smoke detector or a heat sensor is alarming. Shape and/or color differentiation as described herein are exemplary of a plurality of combinations of LED shape and color indicators that can be used for the invention.

FIG. 4 further shows that mimic overlay 80 includes the general location of individual fire fighting equipment, shown as equipment indicators 86, positioned within upper occupied area 14. Equipment indicators 86 are not required to be LEDs and therefore preferably provide visual indication of locations for firefighting equipment within the various compartments. Optionally, equipment indicators 86 are also provided with LEDs which illuminate the indicators. Examples of equipment located within the compartments are handheld fire extinguishers and smoke hoods. Equipment indicators 86 assist in quickly locating the individual pieces in a potentially smoke filled environment. A heat sensor LED 88, adjacent to stairway 58 (shown in FIG. 3), is an important indicator for personnel attempting to access upper occupied area 14. An alarming condition of heat sensor LED 88 indicates elevated temperatures adjacent to door 60 and the potential for fire immediately adjacent to door 60. A non-alarming condition of heat sensor LED 88 provides some assurance that conditions are suitable for personnel to enter door 60.

By indicating a first smoke detector or a first heat sensor to alarm with a blinking light on display panel 62, personnel viewing display panel 62 can identify the probable location for the start of the smoke or fire event within upper occupied area 14. This further aids personnel in establishing the immediate direction to turn when entering the space. Because elevated temperatures are the primary concern for personnel entering spaces, an alarming or energized heat sensor LED will normally be the first location personnel will attempt to access when entering the space. FIG. 4 identifies a single display panel 62 located adjacent to a single entrance door into upper occupied area 14. It is common that more than one access door or opening is provided to each potentially occupied space. An individual display panel 62 is therefore located adjacent to each entranceway or door into an individual space.

Relay switches 70 identified in control unit 66 operate as known in the art. When a signal is received from one of the smoke detectors or heat sensors A or B, a relay switch 70 trips which permits electric current to flow to the designated one of smoke detector LED 82 or heat sensor LED 84. By biasing the first alarming detector or sensor associated capacitor 72, the first alarming detector or sensor signal is differentiated from any subsequent signal. This further helps personnel viewing display panel 62 to distinguish between the first alarming smoke detector or heat sensor from any subsequent one. Mimic overlay 80 is not limited to the configuration shown in FIG. 4. Mimic overlay 80 is exemplary and is different for each compartment represented on each display panel 62 to distinguish between individual areas or compartments of aircraft 10.

Figure 5:
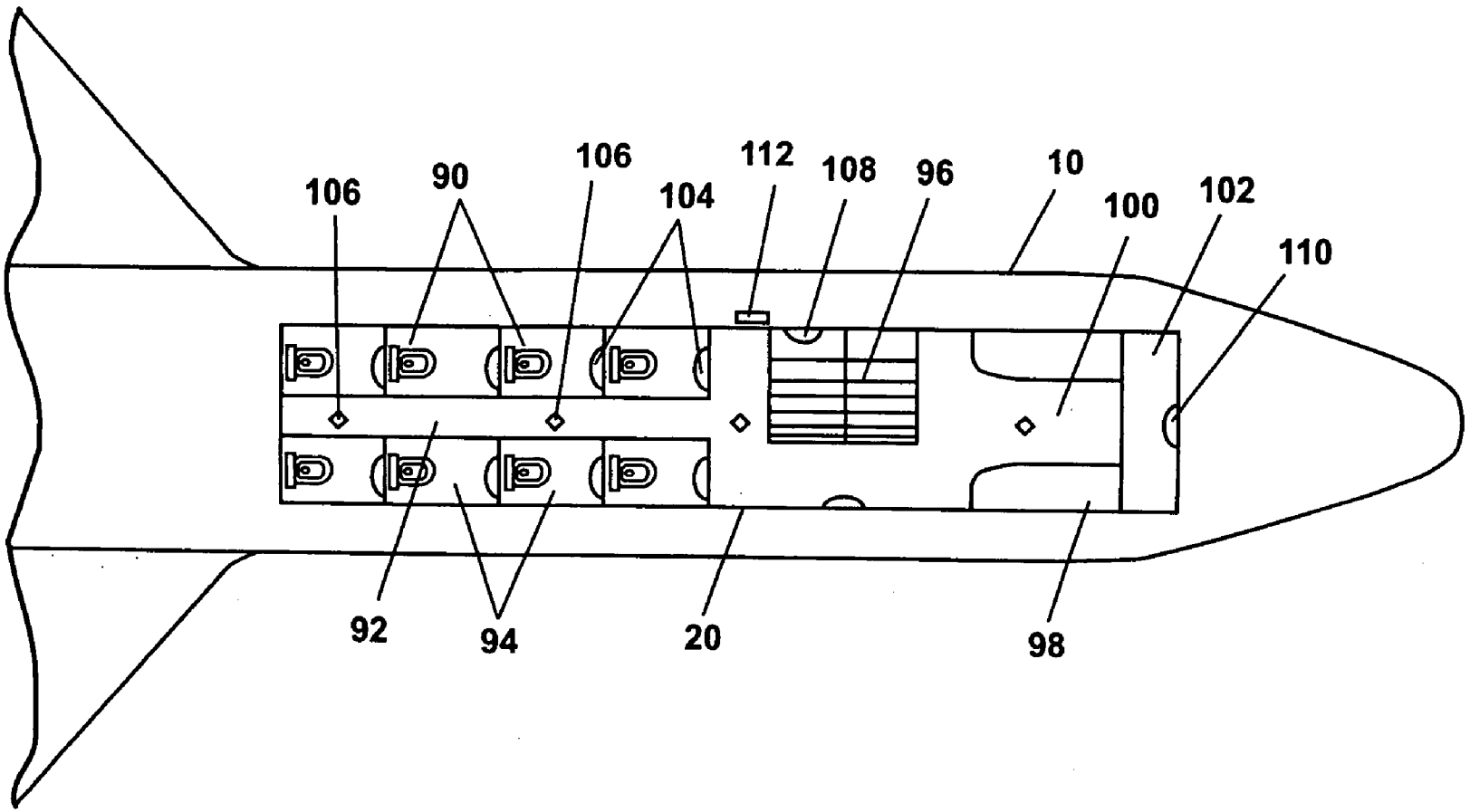
FIG. 5 is a plan view of a lower level aircraft arrangement taken at Section 5—5 of FIG. 2 incorporating heat sensors and smoke detectors according to the present invention.

As best seen in FIG. 5, lower occupied area 20 of aircraft 10 is further detailed. Lower occupied area 20 includes a plurality of aft port lavatories 90, an aft lower passageway 92, and a plurality of aft starboard lavatories 94. A stairway 96 provides access between passenger area 12 (shown in FIG. 1) and lower occupied area 20. A plurality of seats 98 are provided at a forward end of lower occupied area 20. A lounge area 100 is formed adjacent to seats 98. An exemplary closet 102 is also shown. Closet 102 would normally be isolated from lounge area 100 by a door (not shown).

Each lavatory 90, 94 includes at least a smoke detector such as a smoke detector 104. A plurality of heat sensors 106 are also dispersed throughout lower occupied area 20, similar to those arranged in upper occupied area 14. A stairway smoke detector 108 is generally arranged at an upper elevation of stairway 96. A closet smoke detector 110 is provided within closet 102. A display panel 112, similar in function to display panel 62, is located adjacent to an entranceway into stairway 96. Display panel 112 will be described in further detail in reference to FIG. 6.

Figure 6:
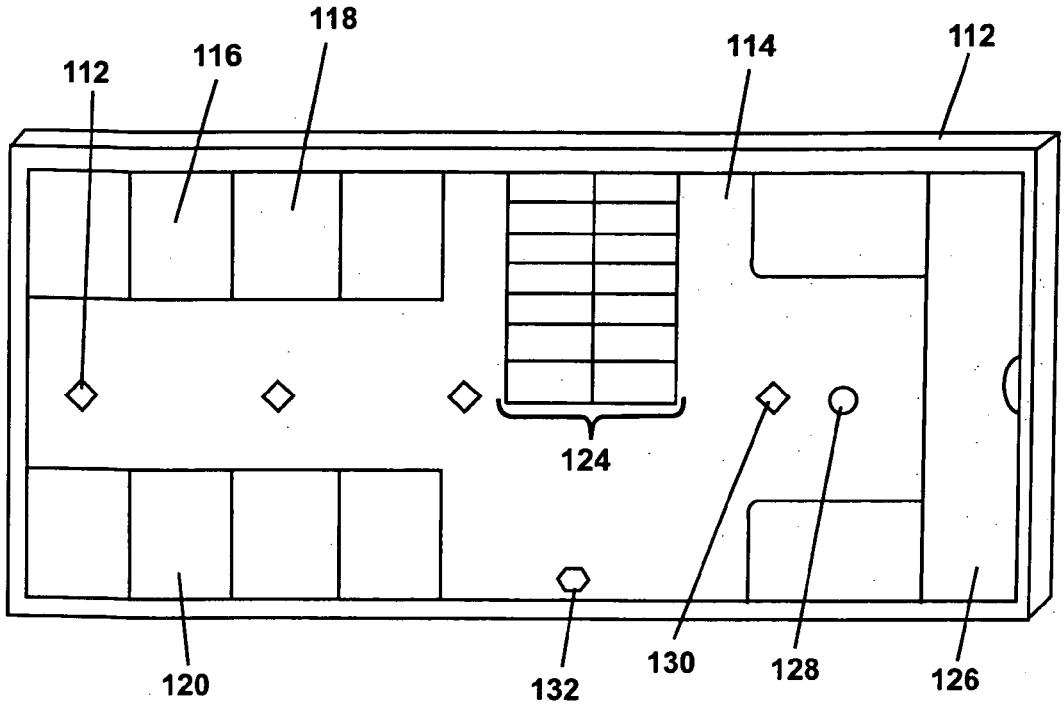
FIG. 6 is a perspective view of a display panel having a fascia arrangement mimicking the aircraft configuration shown in FIG. 5.

Referring to FIG. 6, display panel 112 provides a mimic display 114 describing lower occupied area 20. Display panel 112 is an alternate embodiment from display panel 62. In this embodiment, separate smoke detector LEDs are not provided. In place of smoke detector LEDs, areas such as lavatory 90 and 94, as well as closet 102 (described in reference to FIG. 5), are represented by display panel 112 as individual zones which will illuminate upon receiving a smoke detector alarm signal. For example, a lavatory zone 116, a lavatory zone 118, and a lavatory zone 120 are shown. If the smoke detector within the lavatory indicated by lavatory zone 116 alarms, the entire zone of lavatory zone 116 will illuminate. The same is true for any of the remaining lavatories, including those represented by lavatory zones 118 and 120 respectively. In this embodiment, individual heat sensor LEDs such as heat sensor 122 are still used. Similar to the lavatory zones, if a detector or sensor alarms within the general area of stairway 96 (shown in reference 5), a stairway zone 124 will illuminate in its entirety. Similarly, if closet smoke detector 110 alarms, a closet zone 126 will illuminate. Depending upon the geometry of the specific area involved, and as chosen by the designer, lounge area 100 (shown in FIG. 5) can be designated on mimic display 114 as a lounge smoke detector 128 and a lounge heat sensor LED 130, or by individual zone indicators as previously described herein. Similar to mimic overlay 80, mimic display 114 provides at least one equipment symbol 132 representing a location for firefighting equipment such as a fire extinguisher or a smoke hood. Although zones, or zones in combination with LEDs are shown in reference to mimic display 114, a first zone or a first LED connected to either a smoke detector or a heat sensor in lower occupied area 20 to alarm will result in a flashing zone or LED indicator. Second or subsequent alarming smoke detectors or heat sensors in lower occupied area 20 are indicated by a steady "ON" indication light.

Figure 7:
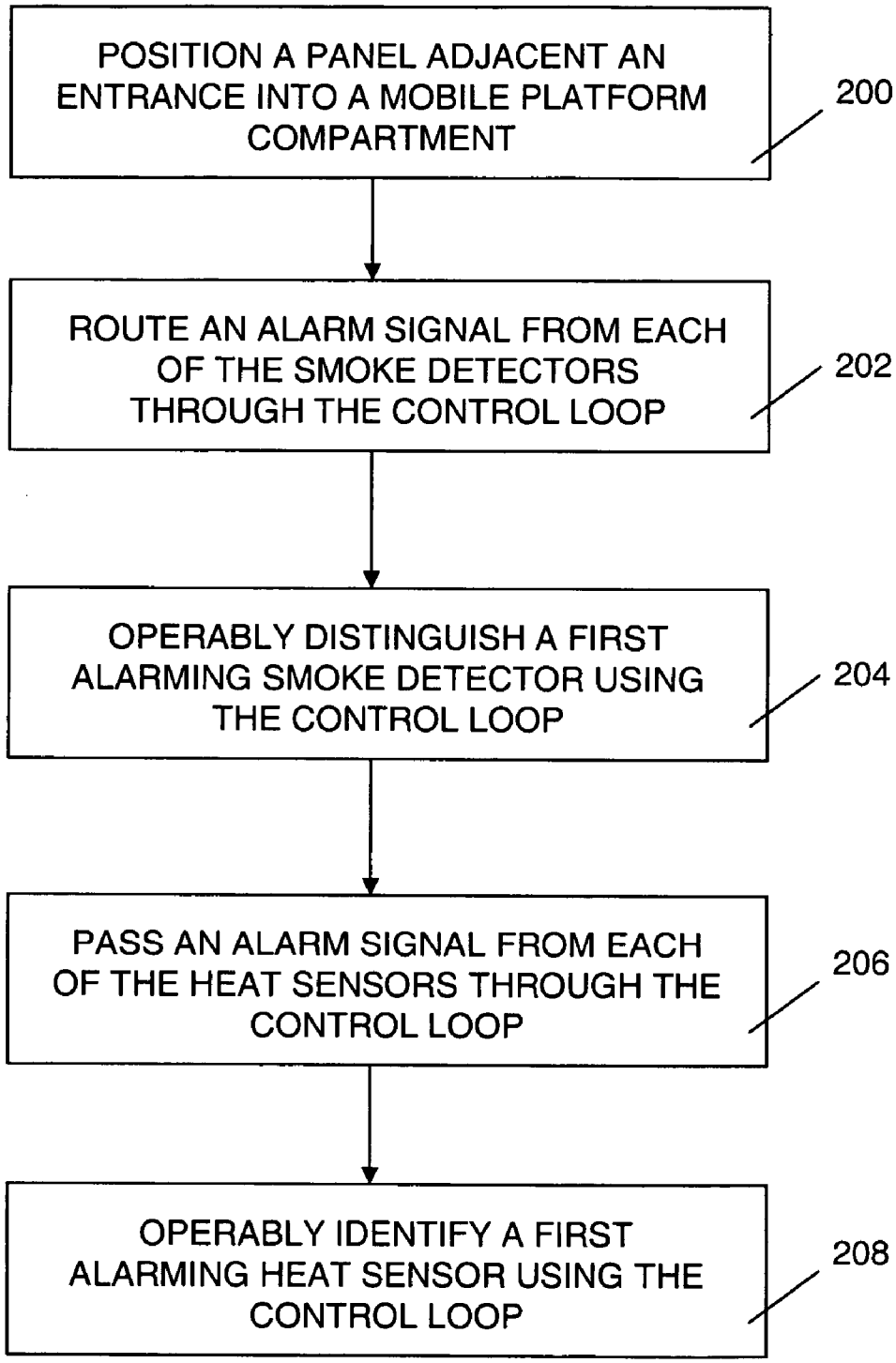
FIG. 7 is a flow diagram of the operations for a preferred embodiment of the present invention.

Referring to FIG. 7, a method for identifying the presence of smoke and/or fire in a mobile platform is provided. The mobile platform has a plurality of smoke detectors and a plurality of heat sensors, each connectable through a control loop to a predetermined indicator on a remote panel. In an operation 200, the panel is positioned adjacent an entrance into a mobile platform compartment. In an operation 202, an alarm signal is routed from each of the smoke detectors through the control loop. In a next operation 204, a first alarming smoke detector is operably distinguished using the control loop. In a further operation 206, an alarm signal is passed from each of the heat sensors through the control loop. Finally, in an operation 208, a first alarming heat sensor is operably identified using the control loop.

In yet another embodiment of the present invention, a smoke detector/heat sensor combination unit is provided. This combination unit adds a heat sensor to a commonly available smoke detector unit. By combining both a smoke detector and a heat sensor into a single unit, individual component costs as well as installation space requirements are reduced.

In addition to a heat sensor having a single alarm set point of approximately 175° F., the smoke and fire indication system of the present invention can also provide a rate of increase of temperature associated with each heat sensor. For example, a compartment seeing a rapid elevation in temperature from ambient to less than the predetermined set point or alarm point of the heat sensor, a separate alarm or indication can be provided which identifies to personnel that a potential fire or high temperature condition exists, which warrants investigation. At the discretion of the designer, the alarm set point for a high temperature rate increase can be selected, for example, based on a degree Fahrenheit change per unit time.

In a preferred embodiment of the present invention, different colors are used to differentiate between an alarming smoke detector and an alarming heat sensor. For example, an orange LED can be used for an alarming smoke detector LED and a red color can be used for an alarming heat sensor LED. Any color combination differentiable to a viewer is acceptable. In another aspect of the present invention, for a display panel having zones described herein in reference to FIG. 6, zone lighting can change in color intensity or the color itself can vary depending upon receipt of a smoke detector alarm signal, a high rate of temperature alarm or a set point high temperature alarm from a heat sensor. The LEDs identified herein can also be replaced with other known light/illumination indicators, such as light bulbs or liquid crystal displays, without departing from the spirit and scope of the present invention.

A smoke and fire indication system 22 of the present invention offers several advantages. By providing a combination of smoke detectors and heat sensors, personnel alerted to an alarming condition are provided with both information concerning smoke indication and elevated temperature indication which help determine whether a smoldering condition or possibly an open flame condition exists within a particular compartment or space. By combining the indication for both the smoke detector and heat sensors of the present invention onto individual display panels located adjacent to a compartment, lavatories, normally inaccessible areas, and other potential personnel occupied spaces of a vehicle, personnel viewing the display panel can identify before entering the space the potential specific location where a smoke source may be, or where a fire may be located. By using either a light emitting diode or a lit zone on a mimic area of a display panel of the present invention, the first smoke detector or heat sensor to alarm can also be distinguished between other alarming smoke detectors or heat sensors in the area. This further assists personnel in identifying the most probable location for the start of the smoke or fire event. Through the use of heat sensors of the present invention, it is also possible for personnel who are about to enter a compartment or space to first identify if an unsafe condition exists, such as a temperature elevated to a potentially lung damaging level.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent art.

What is claimed is:

1. A mobile platform fire detection/indication system, comprising:

a plurality of smoke detectors;

a plurality of heat sensors;

a panel having a plurality of indicators, positioned adjacent to an entrance into the mobile platform, each of the indicators remotely connectable to individual ones of the smoke detectors and the heat sensors;

a compartment mimic disposed on the panel defining a general configuration of a mobile platform compartment;

a predetermined position for each of the indicators on the mimic defining one of an approximate smoke detector location and an approximate heat sensor location, at least one first designator position on the mimic, wherein a location of the first designator visually defines a corresponding location of a piece of fire fighting equipment located within the compartment; and wherein each of the indicators defines one of a plurality of compartment zones, each of the compartment zones having a predetermined shape, each indicator when lit mimicking entirely the predetermined shape of one of the compartment zones to visually distinguish on the panel an alarming zone location by the predetermined shape.

2. The system of claim 1, wherein each indicator comprises an energizable light.

3. The system of claim 2, wherein each energizable light comprises a light emitting diode.

4. The system of claim 2, wherein each energizable light comprises:

a first color lens visually defining each indicator connectable to one of the smoke detectors; and a second color lens visually defining each indicator connectable to one of the heat sensors.

5. The system of claim 1, wherein each compartment zone comprises a zone lighting device operably illuminated when a predetermined one of the smoke detectors operably alarms.

6. The system of claim 5, comprising:

an energizable light connectable to each of the heat sensors; and a predetermined one of the energizable lights being positionable one of within and adjacent to at least one of the compartment zones.

7. The system of claim 1, comprising:

at least one second designator positionable on the mimic;

wherein a location of the second designator visually defines a corresponding location of a compartment door.

8. A method for identifying the presence of smoke and fire in a mobile platform, the mobile platform having a plurality of smoke detectors and a plurality of heat sensors, each connectable through a control loop to a predetermined indicator on a remote panel, the method comprising:

positioning the panel adjacent an entrance into a mobile platform compartment;

routing a smoke alarm signal from each of the smoke detectors through the control loop;

operably and visually distinguishing a first alarming smoke detector from a second and any subsequent alarming ones of the plurality of smoke detectors;

passing an alarm signal from each of the heat sensors through the control loop; and operably identifying a first alarming heat sensor using the control loop.

9. The method of claim 8, comprising energizing a first one of the predetermined indicators connectable to the first alarming smoke detector with a first smoke detector alarm pattern.

10. The method of claim 9, comprising energizing a second one of the predetermined indicators connectable to the first alarming heat sensor with a first heat sensor alarm pattern.

11. The method of claim 10, comprising energizing a successive one of the predetermined indicators connectable to a subsequently alarming heat sensor with a second heat sensor alarm pattern.

12. The method of claim 9, comprising energizing a successive one of the predetermined indicators connectable to a subsequently alarming smoke detector with a second smoke detector alarm pattern.

13. The method of claim 8, comprising relay switching individual ones of the alarm signals from each of the smoke detectors through a capacitor.

14. The method of claim 8, comprising relay switching individual ones of the alarm signals from each of the heat sensors through a capacitor.

15. The method of claim 8, comprising:

identifying each of the alarm signals from each of the smoke detectors using a first color; and designating each of the alarm signals from each of the heat sensors using a second color.

16. A mobile platform fire detection system, comprising:

a plurality of smoke detectors locatable in a compartment of a mobile platform;

a plurality of heat sensors positioned in the compartment;

an indication panel locatable outside of the compartment, the panel operable to automatically visually identify any of a smoke detector smoke alarm condition and a heat sensor heat alarm condition; wherein said smoke detectors and heat sensors, each connectable through a control loop to a predetermined indicator on the panel a first smoke detector signaling indicator positioned on the indication panel and connected to a first one of the smoke detectors and operable to indicate the smoke detector smoke alarm condition of the first smoke detector;

a second smoke detector signaling indicator positioned on the indication panel and connected to a second one of the smoke detectors and operable to indicate the smoke detector smoke alarm condition of the second smoke detector;

a blinking light defining a first energized one of the first and second smoke detector signaling indicators indicating the smoke detector smoke alarm condition of a first alarming one of the first and second smoke detectors; and a continuously-energized-on light defining a second energized one of the first and second smoke detector signaling indicators indicating the smoke detector smoke alarm condition of a second alarming one of the first and second smoke detectors.

17. The system of claim 16, comprising:

a plurality of heat sensor signaling indicators positioned on the indication panel, each remotely connectable to an individual one of the heat sensors and each operable to indicate the heat sensor alarm condition of one of the individual heat sensors;

wherein a first one of the heat sensor signaling indicators operably indicating the heat sensor alarm condition defines a first heat indication signal differentiable from a second heat indication signal produced by any subsequent one of the heat sensor signaling indicators to indicate the heat sensor alarm condition.

18. The system of claim 17, wherein the first heat indication signal comprises a blinking light.

19. The system of claim 17, wherein the second heat indication signal comprises a continuously-energized-on light.

20. The system of claim 17, comprising:

a first color visually defining the smoke detector signaling indicators; and a second color visually defining the plurality of heat sensor signaling indicators.

21. The system of claim 16, wherein each heat sensor comprises a threshold alarm set point.

22. The system of claim 21, wherein the threshold alarm set point comprises a predetermined temperature of approximately 175 degrees F.

23. The system of claim 16, wherein at least one of the heat sensors is positionable adjacent a compartment door.

24. The system of claim 16, comprising a rate of heat increase indication operably provided by each heat sensor.

25. The system of claim 24, comprising a rate of heat increase alarm signal operably provided by the indication panel.

26. The system of claim 16, wherein the indication panel is positioned proximate to an entrance to the compartment, permitting a viewer to distinguish an approximate location in the compartment of the first alarming one of the smoke detectors to determine if a smoke event is occurring proximate to the entrance prior to entering the compartment.

* * * * *